US010987794B2

(12) United States Patent
Frenken

(10) Patent No.: US 10,987,794 B2
(45) Date of Patent: Apr. 27, 2021

(54) ACCUMULATOR-OPERATED HAND-HELD WORKING APPARATUS AS WELL AS METHOD FOR OPERATING SUCH AN APPARATUS

(71) Applicant: GUSTAV KLAUKE GMBH, Remscheid (DE)

(72) Inventor: Egbert Frenken, Heinsberg (DE)

(73) Assignee: GUSTAV KLAUKE GMBH, Remscheid (DE)

( * ) Notice: Subject to any disclaimer, the term of this patent is extended or adjusted under 35 U.S.C. 154(b) by 150 days.

(21) Appl. No.: 16/254,847

(22) Filed: Jan. 23, 2019

(65) Prior Publication Data

US 2020/0230797 A1 Jul. 23, 2020

(51) Int. Cl.

| | |
|---|---|
| ***B25F 5/00*** | (2006.01) |
| ***B25F 5/02*** | (2006.01) |
| *B25B 27/02* | (2006.01) |

(52) U.S. Cl.

CPC ..... *B25F 5/02* (2013.01); *B25B 27/026* (2013.01); *B25F 5/005* (2013.01)

(58) Field of Classification Search

CPC ..... B25F 5/00; B25F 5/02; B25F 5/023
USPC ..... 173/2
See application file for complete search history.

(56) References Cited

U.S. PATENT DOCUMENTS 6,330,503 B1 * 12/2001 Sharp ..... B05B 12/124 701/50
6,502,949 B1 * 1/2003 Horiyama ..... B23Q 11/0046 173/217
6,598,684 B2 * 7/2003 Watanabe ..... B25B 21/02 173/176
7,254,982 B2 8/2007 Frenken
7,628,219 B2 * 12/2009 Frauhammer ..... B25F 5/026 173/18
8,056,473 B2 11/2011 Frenken
9,256,988 B2 * 2/2016 Wenger ..... G07C 3/02
(Continued)

FOREIGN PATENT DOCUMENTS

EP 0155077 B1 2/1991
WO 03/084719 A2 10/2003
(Continued)

OTHER PUBLICATIONS

"This Adapter Lets You Use Power Tool Batteries to Power Your Camera Gear", LOWES, Jan. 14, 2020 (Year: 2020).*
(Continued)

*Primary Examiner* — Gloria R Weeks
(74) *Attorney, Agent, or Firm* — Klintworth & Rozenblat IP LLP

(57) ABSTRACT

An assembly including an accumulator-operated hand-held working apparatus and a functional module, and method of operating same is provided. The apparatus includes a drive, an accumulator, and a control device, which has a data storage element and a microprocessor. In response to a trigger impulse, the control device can automatically control a performance of a work process. A radio module of the functional module, which can optionally be connected to the apparatus. A connection can be established in the functional module in terms of conduction only for the power supply upon a connection to the apparatus, or can inductively be supplied with power.

20 Claims, 7 Drawing Sheets

(56) References Cited

U.S. PATENT DOCUMENTS 10,735,833 B2 * 8/2020 Stampfl ..... B25B 21/00
2002/0033267 A1 * 3/2002 Schweizer ..... B25B 31/00 173/2
2003/0089511 A1 * 5/2003 Tsuneda ..... B25B 21/00 173/217
2004/0182587 A1 * 6/2004 Wiesner ..... B25F 5/00 173/2
2009/0205848 A1 * 8/2009 Wilson, Jr. et al. ..... B25B 23/1405 173/2
2012/0167721 A1 * 7/2012 Fluhrer ..... B25B 21/002 173/1
2012/0312570 A1 * 7/2012 Fluhrer ..... B25B 23/14 81/54
2014/0107853 A1 * 4/2014 Ashinghurst ..... B25F 5/00 700/297
2014/0117922 A1 * 5/2014 Pham ..... B25F 5/00 173/1
2014/0158389 A1 * 6/2014 Ito ..... B25F 5/00 173/46
2014/0245620 A1 * 9/2014 Fankhauser ..... B25F 5/02 30/374
2014/0262391 A1 * 9/2014 Eardley ..... H02J 7/0044 173/20
2015/0014004 A1 * 1/2015 Schubert ..... B23B 49/00 173/1
2015/0122522 A1 * 5/2015 Fujimoto ..... B25B 23/14 173/1
2015/0309640 A1 * 10/2015 Vuckovic ..... B25F 5/00 173/1
2015/0364889 A1 12/2015 Frenken
2016/0311094 A1 * 10/2016 Mergener ..... B25B 23/1475
2018/0243887 A1 * 8/2018 Hohmann ..... B25B 23/14

FOREIGN PATENT DOCUMENTS

WO 2008138987 A2 11/2008
WO 2014108361 A1 7/2014

OTHER PUBLICATIONS

English language machine translation of WO 03084719 A2.
English language machine translation of WO 2008138987 A2.
English language machine translation of WO 2014108361 A1.

* cited by examiner 1
2
9
3
13
33
28
15
27
22
8
7
10

ACCUMULATOR-OPERATED HAND-HELD WORKING APPARATUS AS WELL AS METHOD FOR OPERATING SUCH AN APPARATUS

FIELD OF TECHNOLOGY

The invention initially relates to an accumulator-operated hand-held working apparatus comprising a drive, an accumulator, and a control device, which has a data storage element and a microprocessor, wherein, in response to a trigger impulse, for instance generated by a touch of a button, the control device can automatically control a performance of a work process.

The invention further relates to a method for operating an accumulator-operated hand-held working apparatus comprising a drive, an accumulator, and a control device, which has a data storage element and a microprocessor.

PRIOR ART

Hand-held working apparatuses as well as methods of the type in question are known. In particular in the case of accumulator-operated hand-held working apparatuses, a work process is triggered as a result of an impulse, for example as a result of actuation of a trigger button on the working apparatus. This work process can be performed at least partially, preferably completely automatically, by means of the apparatus-side control device.

Such apparatuses are, for example, not exclusively, accumulator-operated pressing, punching, crimping or cutting apparatuses, as they are further known, for example, from WO 2003/084719 A2 (U.S. Pat. No. 7,254,982 B2) or from EP 1 555 077 B1 or from WO 2008/139897 A2 (U.S. Pat. No. 8,056,473 B2) or from WO 2014/108361 A1 (US 2015/0364889 A1).

SUMMARY OF THE INVENTION

It is the object of the present invention to further improve and/or functionally expand a hand-held working apparatus of the type in question as well as a method for operating such an apparatus.

According to a first idea of the invention, a possible solution of the object is at hand in the case of a hand-held working apparatus, which focusses on that a radio module is further provided and that the radio module is part of a functional module, which can optionally be connected to the hand-held working apparatus, wherein the functional module can form a connection in terms of conduction only for the power supply upon a connection to the hand-held working apparatus or can be inductively supplied with power.

With regard to the method, a possible solution of the object is provided in that a radio module is provided, which is part of a functional module, which can optionally be connected to the hand-held working apparatus, wherein the functional module is brought into a functional connection with the hand-held working apparatus only for the power supply.

As a result of this embodiment, a hand-held working apparatus of increased practical value is created. The method is expanded in an advantageous manner.

The working apparatus can possibly be provided, only if needed, with a functional module, which in particular has a radio module. The working apparatus can thereby be expanded accordingly by the possibility of a data connection via radio via the functional module.

The radio module can use known radio interfaces for this purpose, thus, for example, Bluetooth or other standard radio interfaces. For example a log-in into a radio network, for example WLAN or WPAN, can further also be made possible via the radio module.

In preferred embodiment, a direct or indirect electrical connection to the hand-held working apparatus is present only for the power supply of the functional module, thus either via a connection in terms of conduction or via an inductive connection. A mechanical fastening of the functional module to the working apparatus is preferably further provided.

A possible data exchange between functional module and working apparatus preferably takes place only via radio, for the purpose of which the hand-held working apparatus in this case also has a radio module, which is controlled via the apparatus-side microprocessor. The functional module can possibly influence a started work process or can start it via this radio interface, for example by using parameters transmitted in this way.

The radio interfaces between the functional module and the hand-held working apparatus, as well as between the functional module and a remote functional partner, such as, for example, a computer in a network, can be embodied to act uni-directionally or also bi-directionally.

Further features of the invention are described below, also in the figure description, often in their preferred assignment to the subject matter of claim 1 and/or of the further independent claim(s) or to features of further claims. However, they can also be significant in an assignment to only individual features of claim 1 and/or of the further independent claim(s) or of the respective further claim or in each case independently.

According to a possible embodiment, the hand-held working apparatus can thus also carry out a control of the work process without the functional module. Accordingly, a pressing, for example in the area of a pipe joint, can certainly also be made without the functional module, for example in the case of the embodiment of the hand-held working apparatus as pressing working apparatus. In response to the trigger impulse, the usual control routine, which carries out an advancing of the movable pressing jaw, is thereby triggered by actuation of a button, for example until reaching a specified pressing force, whereupon a return of the movable pressing jaw takes place, preferably automatically. Such a work process can certainly also be performed without connected and/or activated functional module.

In the case of connected functional module, the work process can possibly be influenced via said functional module, possibly adapted to the local conditions and/or to the possibly special embodiment of the workpieces to be machined in this case. A control of the work process can possibly also be carried out via the functional module, possibly a documentation, wherein a corresponding transmission of such information via radio can further be made possible via the provided radio module.

For this purpose, the hand-held working apparatus and/or the functional module can further have a display. The display can display specified parameters for performing the work processes, but possibly also values reached as part of the work process or at the end of the work process, respectively, such as, for example, pressure values, but possibly also process times. The charge state of the apparatus-side accumulator, for example, can further also be displayed via such a display. Moreover, such a display can also be used to display visualized application guidelines for the user of the working apparatus.

The hand-operated working apparatus and/or the functional module can also have a camera, which, for example and in particular can also be used for the documentation of the performed work process. The photographs or film sequences created via the camera can be transmitted via the radio module and/or can be stored in a possibly module-side data storage unit and/or can be displayed on a possibly provided display.

The functional module can also have a microphone and/or a loudspeaker. For example, comments by the user can be recorded by means of the microphone, further for example as part of performing a work process. For example, relevant instructions to the user for the upcoming work process can be announced via the loudspeaker.

In further embodiment, the hand-held working apparatus and/or the functional module can have a position sensor for capturing a relative alignment of the functional module and via the latter of the hand-held working apparatus, for example relative to a horizontal plane.

Moreover, the hand-held working apparatus and/or the functional module can have a GPS module. By using such a GPS module, a local localization of the functional module and via the latter thus of the connected hand-held working apparatus is made possible. The localization of a hand-held working apparatus from afar by using corresponding applications is also possible thereby. An application, which, by using the GPS module, displays the current position on a display, can be started with the activation of the functional module.

For example and in particular for the possible log-in of the functional module into a common mobile radio network, the hand-held working apparatus and/or the functional module can have a SIM card. Such a SIM card can possibly also be used for the localization of the hand-held working apparatus.

In preferred embodiment, the functional module has an antenna, in particular an antenna, which is integrated in the functional module.

In further embodiment, the functional module can be embodied in the manner of a common smartphone, provided that it is to have a SIM card and/or a GPS module and/or a display and/or a camera. For applications, which in particular do not require a display and/or a camera, the functional module can also be a functional part, which is reduced in terms of size, which has the required radio module and preferably in particular an antenna.

The functional module can have a cable connection via a further possible USB connector plug. This USB cable connection can serve for the electrical connection to the accumulator of the hand-held apparatus, for the corresponding power supply of the functional module. A data exchange can possibly also be made possible via the USB connection, in particular a data exchange to an external apparatus. The data storage of the functional module can thus be read, for example via such a USB connection, possibly also when the functional module is not connected to the hand-held apparatus or is not fastened thereto, respectively.

The hand-held working apparatus can have a USB socket, for example assigned to the control device. Said USB socket can serve for the connection of a functional module comprising USB connector plug, for example in the case of the embodiment of the functional module in the manner of a Bluetooth dongle or a UMTS stick (surfstick).

The functional module can furthermore have a data storage unit.

By using such a data storage unit, the functional module can temporarily store different data, possibly captured via the functional module and/or via the working apparatus, but possibly further also data input by the user of the working apparatus, possibly by hand. The data of the storage unit can be transmitted via the functional module by using the radio module. In the alternative or also in combination therewith, data received via the radio module can also be stored in the data storage unit.

The data possibly stored in the data storage unit can serve for the further use, in particular proper use of the hand-held working apparatus, thus for example include processing parameters. These exemplary processing parameters can be used with direct impact on the control device of the working apparatus, i.e. without further necessary action by the user. The data stored in the data storage unit can also show for example processing specifications solely to the user.

In the case of a connection to the hand-held working apparatus, the functional module can initially and generally remain in a so-called stand-by mode, when the hand-held working apparatus is not used. According to a possible embodiment, the functional module can be capable of being activated as a result of a significant current and/or voltage change captured at the accumulator of the hand-held working apparatus. On principle, such a significant current and/or voltage change is captured with triggering of a work process. For example an electric motor or an electric pump is controlled via the control unit, for example by actuation of an apparatus-side button or the like. This leads to the above-mentioned significant change with regard to the current and/or the voltage, which is captured via the control device. The functional module is switched into the active mode immediately with the capturing of this significant change. For this purpose, the control device can preferably send a "wake-up impulse" to the functional module, preferably via radio.

The stand-by mode of the functional module can also be triggered automatically at the end of the work process, which preferably runs automatically, and a further significant current and/or voltage change, which is triggered, for example, by turning off the electric motor or the electric pump.

In further embodiment, the drive of the hand-held working apparatus can only be activated, when the functional module is activated. According to a possible embodiment, the drive, in particular electric drive of the hand-held working apparatus, can initially react due to the trigger impulse, so that a significant current and/or voltage change, as mentioned above, can be captured. However, if after this, the functional module cannot be brought into the activated state as a result of this captured change, because said functional module is possibly not present or the power supply of the functional module is not sufficient, the work process is stopped or is not continued, respectively, according to a possible embodiment. It is thus ensured in this case that the work process can only be performed in connection with the activated functional module.

In a possible embodiment, the functional module can be arranged in an adapter part, which can be connected to a body part of the hand-held working apparatus. The adapter part initially and essentially serves for the mechanical mounting of the functional module to the body part. In the case of embodiment of the functional module in the manner of a smartphone, the adapter part can essentially be a part in the manner of a smartphone mount.

The adapter part can be fastened directly to the hand-held working apparatus, for example to the body part, but possibly also to the accumulator housing. A spaced-apart arrangement of adapter part and hand-held working apparatus is also possible in this regard, for example by interconnecting a gooseneck-like extension between the adapter part and a mounting part for fastening to the working apparatus.

The adapter part can thus further be arranged between a body part of the hand-held working apparatus and the accumulator of the hand-held working apparatus. This area can furthermore correspond to the usual handle area of the hand-held working apparatus. The adapter part or the mount, respectively, is embodied so ergonomically favorably in this case that the usual seizing of the working apparatus and the handling thereof is not impaired.

In the case of arrangement and embodiment of a gooseneck-like extension, the adapter part supporting the functional module can be pivotable in the direction of the working area, in particular in the case of arrangement of an electronic camera.

The adapter part can further have cable connections, for passing sensor signals of the accumulator to the body part of the hand-held working apparatus.

In the connected state of the functional module to the hand-held working apparatus, a possibly provided camera and/or a display of the functional module is exposed to the outside, i.e. in particular exposed across a given outer surface of the hand-held working apparatus. A camera preferably points in particular in the direction of the working field of the hand-held working apparatus, while in a further preferred embodiment, a possibly provided display can be directed essentially in the direction of the user operating the hand-held working apparatus.

Camera and/or display, however, can also be brought into a position, which is exposed to the outside, only as part of the usual use of the hand-held working apparatus, possibly with triggering of the work process.

A location notification can be capable of being transmitted via radio by means of the functional module for each performed work process. The location capturing can be attained by using a possible GPS module. Such a location notification can also be made prior to triggering a work process, and the triggering of the work process can possibly be performed only as a function of a location notification, which is to be assessed positively.

The functional module can thus further also be set up in such a way that, in response to an activation for data exchange, it first connects to the control device of the hand-held working apparatus. This connection setup is prioritized in this case. Without such a connection setup, an activation of the work process can possibly not be performed or possibly only a limited selection of different work processes and/or a limited number of work processes.

The functional module can further also establish a radio connection possibly repeatedly and at regular intervals to a remote data storage, which is provided independently of the hand-held working apparatus. The remote data storage can thereby be a spatially adjacent data storage, for example connected via a so-called Bluetooth connection. With regard to this, a computer or the like provided in an adjacent surrounding area (for example up to 10 m) can thus have the data storage. The data storage can furthermore be part of a network via a radio-remote connection, possibly also a so-called cloud storage via an Internet connection.

Information, such as, for example, location information, performed work processes, terminated work processes, charge state of the accumulator, temperature of the hand-held working apparatus, ambient temperature, time, date, geographic height or optical and/or acoustic information, such as digital images, video or audio data, can preferably be transmitted to this remote data storage. Information about the tools used by means of the hand-held apparatus, such as, for example, cutting tool, pressing tool or the like, can furthermore also be further transmitted. In the case of a pressing tool, pressure values can further for example also be transmitted.

According to a further possible embodiment, the functional module can be capable of being turned off in a remote-controlled manner. The remote control can thereby take place by using the radio module. If a radio connection is required between functional module and working apparatus for properly triggering the work process of the hand-held working apparatus, the hand-held working apparatus can possibly be taken out of operation at least temporarily via the remote-controllable turn-off of the functional module, possibly only of the corresponding radio module, or can be limited in its function as a result of the turned-off functional module.

In a so-called stand-by mode of the functional module, the radio interface, for example a Bluetooth interface, is preferably also interrupted. The functional module can be switched back into an activated mode from this stand-by mode by deflection of the supply voltage, i.e. a significant current and/or voltage change. After activating the apparatus or with the triggering of a button or the like of the hand-held apparatus, the radio connection between the functional module and the control device of the hand-held apparatus is thus established, and the actual work process of the working apparatus is preferably triggered only thereafter.

In further embodiment, the functional module is preferably designed in such a way that it connects only and solely to the one hand-held working apparatus, which can be assigned to it. Unambiguous identifications of apparatus and functional module are present thereby, which may possibly need to be compensated to activate the radio connection.

BRIEF DESCRIPTION OF THE DRAWINGS

The invention is described below by means of the enclosed drawing, which, however, only represents exemplary embodiments. A part, which is described only based on one of the exemplary embodiments, and which is not replaced by another part in a further exemplary embodiment due to the particular feature emphasized therein, is thus also described at least as a possibly available part for this further exemplary embodiment. On the drawing.

DESCRIPTION OF THE EMBODIMENTS

Figure 1:
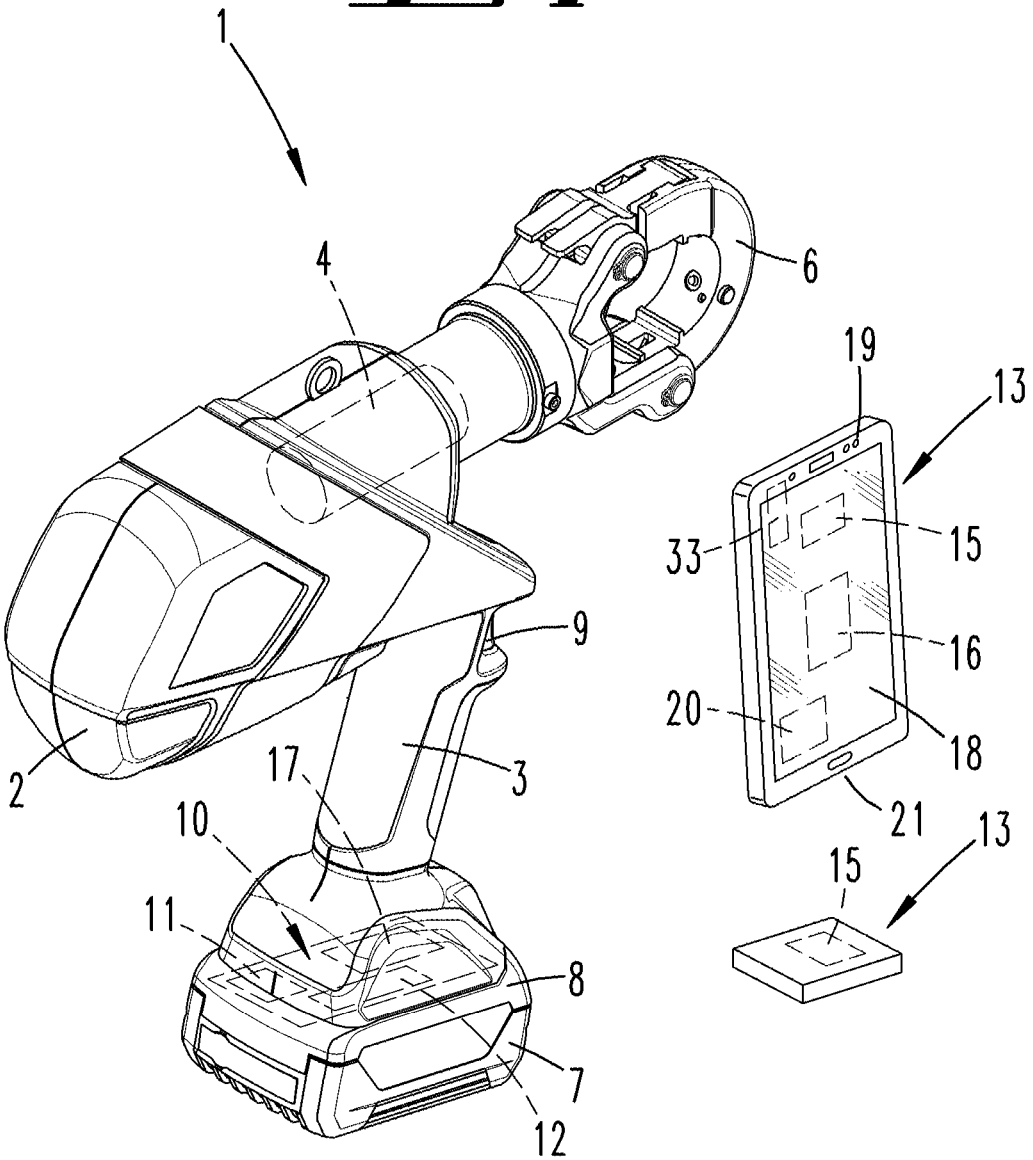
FIG. 1 shows a hand-held working apparatus in a first embodiment comprising two functional modules of a different embodiment in perspective illustration.

What is illustrated and described is, initially with reference to the illustration in FIG. 1, a hand-held working apparatus 1, here in the form of an electro-hydraulically actuatable pressing apparatus in gun-like embodiment.

Such a pressing apparatus is known from the above-cited WO 2014/108361 A1 (US 2015/0364889 A1). The content of this WO publication or U.S. publication, respectively, is hereby included in its entirety into the disclosure of the present invention, also for the purpose of incorporating features of this WO publication or U.S. publication, respectively, into claims of the present invention.

Figure 3:
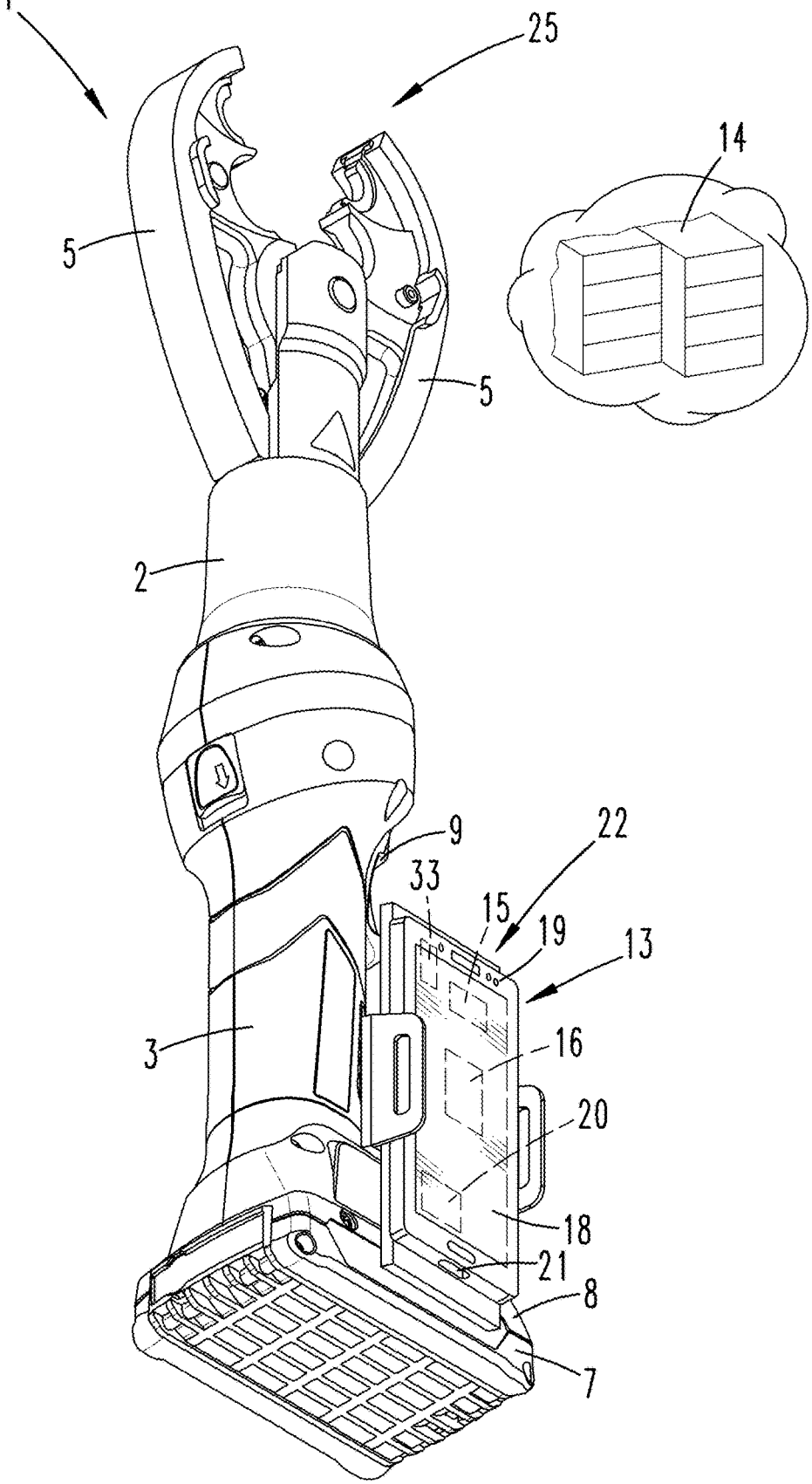
FIG. 3 shows a hand-held working apparatus in further embodiment comprising an alternative arrangement of an adapter part supporting a functional module.

As can further be seen in an exemplary manner in the illustration in FIG. 3, such a hand-held working apparatus 1 can also be present as, for example, pressing apparatus in rod-like embodiment. A hand-held working apparatus 1 embodied in this way in the manner of a pressing apparatus is also known from the above-cited WO 2003/084719 A2 (U.S. Pat. No. 7,254,982 B2). The content of this WO publication or U.S. publication, respectively, is hereby also included in its entirety into the disclosure of the present invention, also for the purpose of incorporating features of this WO publication or U.S. publication, respectively, into claims of the present invention.

Every hand-held working apparatus 1 initially and essentially has a body part 2, which, in the case of a rod-like embodiment according to FIG. 3, simultaneously forms a handle area 3. In the case of a gun-like embodiment of the working apparatus 1 according to the illustration in FIG. 1, the handle area 3 extends essentially transversely to the body part 2.

A drive 4, in the illustrated embodiments an electromotive drive for a hydraulic pump, is preferably provided in the body part 2. A hydraulic medium storage container and a pump arrangement comprising a press piston is further also provided in the body part 2, albeit not illustrated in detail. The press piston can act via a tappet on pivotably displaceable pressing tools 5 according to the illustration in FIG. 3 or on a shiftable pressing jaw, which is not illustrated in detail, which is displaced against a fixed pressing jaw 6 (exemplary embodiment according to FIG. 1). The drive 4 is operated with stored electrical energy via an accumulator 7, which is arranged in the area of the free end of the handle area 3.

The accumulator 7 is mounted in an accumulator receptacle 8, for example catch-mounted. This accumulator receptacle 8 is embodied on the end side of the shaft-like handle area 3, in the case of a rod-like embodiment of the working apparatus facing away from the working end.

A trigger button 9 is arranged in the handle area 3 in handle-convenient manner. Said trigger button can preferably be finger-actuated, preferably actuated by the index finger of the hand, which simultaneously holds and operates the working apparatus 1.

In response to corresponding actuation, a trigger impulse is generated via the trigger button 9, which trigger impulse leads to an automatic performance of a work process, thus, in the case of a pressing apparatus, to a complete pressing as a result of moving the pressing jaws towards one another. After reaching a specified pressing pressure, the tappet acting on the at least one movable pressing jaw automatically moves back into an initial position, by opening the working area 25, here of the pressing jaw.

For this purpose, a control device 10 comprising a microprocessor 11 can as well as preferably be provided in the body part 2.

A part of the control device 10 can also be a data storage element 12, for example for storing work-related parameters, such as, for example, number of performed work cycles, number of terminated work cycles, reached pressing pressure in the case of a pressing apparatus, etc.

For example the data collected in the apparatus-side data storage element 12 can be transmitted to a remote data storage 14, which is provided independently of the hand-held working apparatus 1, by using a functional module 13. This can be, for example, a data storage 14 in a cloud.

By using the functional module 13, different data or also data sets can be transmitted to this external data storage 14, thus for example location information, for the purpose of which a functional module-side GPS module is preferably used, performed work processes or also terminated work processes, the charge state of the accumulator, temperatures of the hand-held working apparatus or also ambient temperatures, time, date, furthermore geographic height at the moment a work process is performed.

For this purpose, the functional module 13 initially and essentially has a radio module 15. A data storage unit 16 can optionally further be provided in the functional module 13, possibly for temporarily storing data transmitted by the hand-held working apparatus 1. An antenna 33 can also be part of the functional module 13, as is preferred.

In preferred embodiment, a connection in terms of conduction of functional module 13 and hand-held working apparatus 1 is provided solely for the power transmission. In a possible embodiment, the functional module 13 thus uses the power of the apparatus-side accumulator 7.

A data transmission from the hand-held working apparatus 1 to the functional module 13 and/or from the functional module 13 to the hand-held working apparatus 1 preferably takes place solely as a result of a radio connection, for the purpose of which the hand-held working apparatus 1 can further have a radio module 17, which cooperates with the microprocessor 11 of the control device 10.

The functional module 13 can be a known mobile telephone, for example and preferably in the form of a smartphone, as illustrated in an exemplary manner in FIGS. 1 to 4. The functional module 13 can accordingly further have a display 18 and/or a camera 19 and/or a SIM card 20 and/or a USB plug 21, furthermore possibly a position sensor and/or a GPS module.

Figure 5:
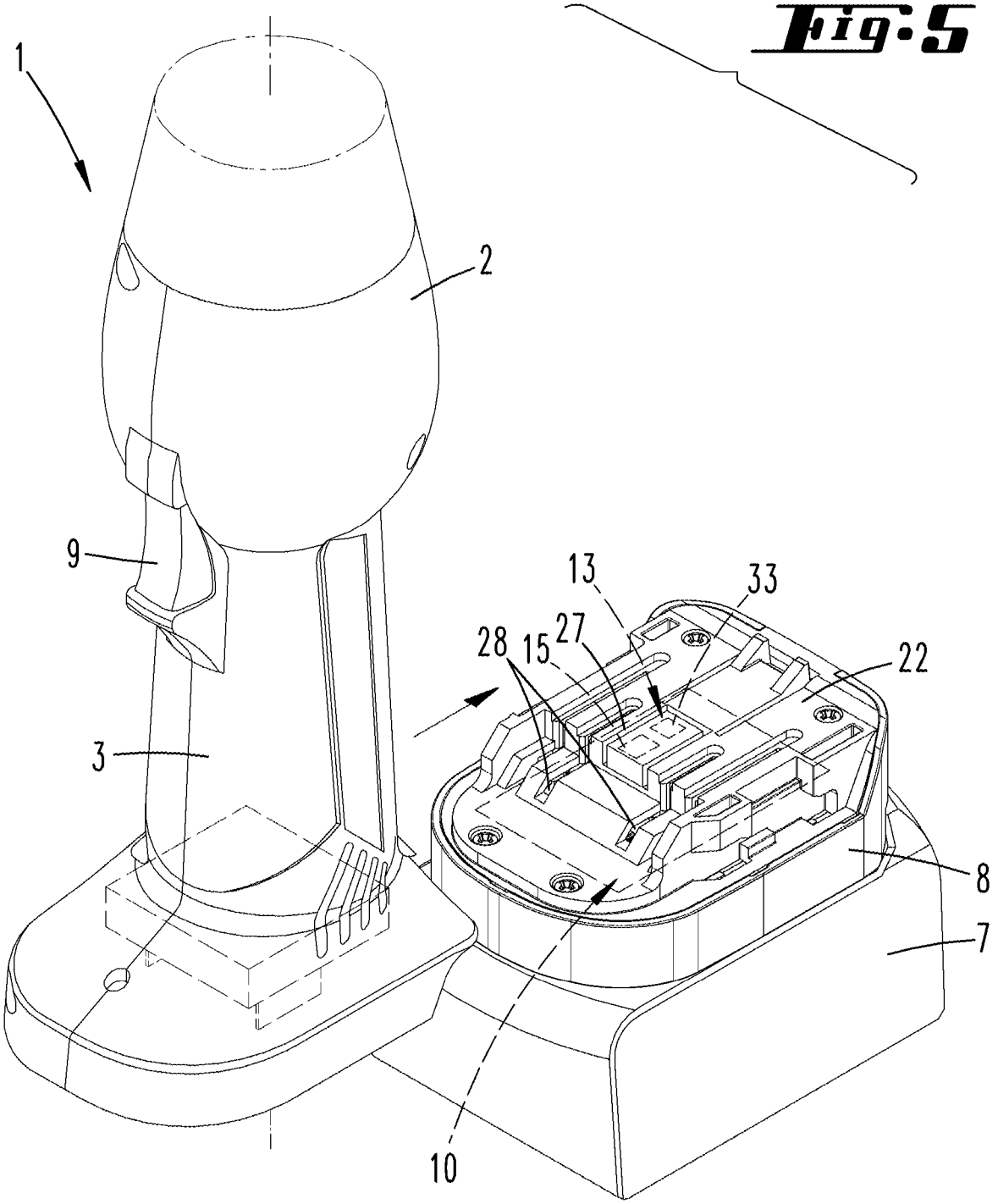
FIG. 5 shows the handle area of a hand-held working apparatus and an assignable accumulator, which can be arranged on the handle part via an adapter, further comprising a functional module received in the adapter.
Figure 6:
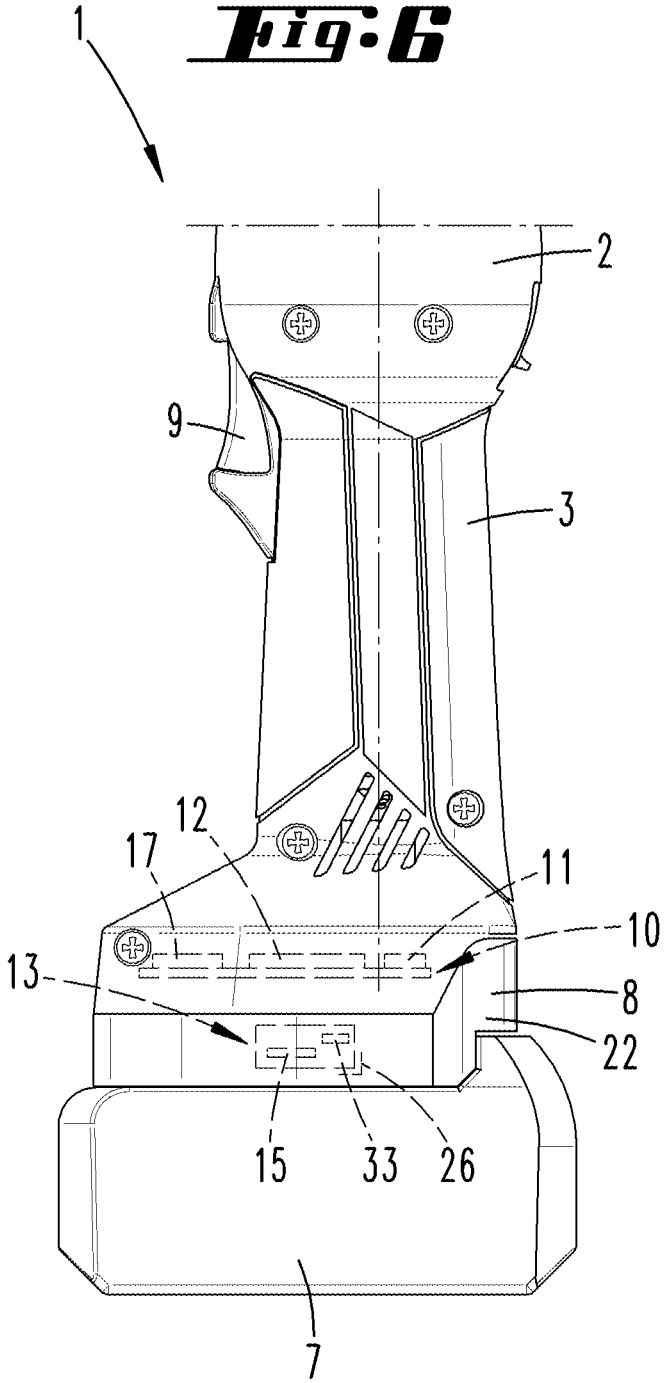
FIG. 6 shows a sectional illustration, which essentially corresponds to FIG. 4, of a hand-held working apparatus comprising a functional module according to FIG. 5.

In alternative embodiment, the functional module 13 can also be present in compact form according to the illustrations in FIGS. 5 and 6, thus in particular having the essential components, such as the radio module 15 and the antenna 33, possibly a data storage unit 16. This leads to a favorably small design.

Figure 7:
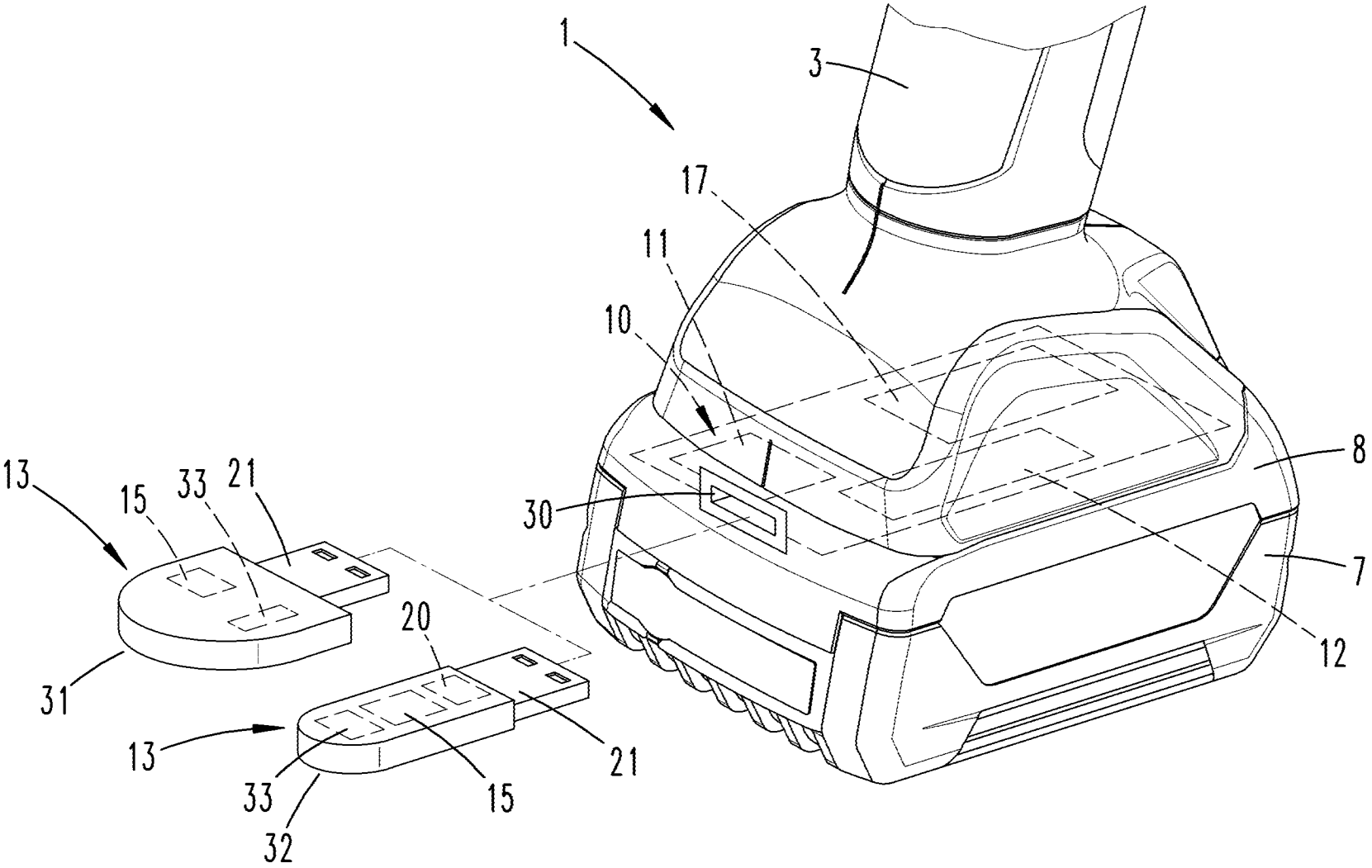
FIG. 7 shows the area of an accumulator arrangement of the hand-held working apparatus comprising a USB socket and assignable functional modules in two embodiments.

According to the illustration in FIG. 7, the functional module 13 can thus be embodied in the manner of a Bluetooth dongle 31 comprising a radio module 15 and an antenna 33, or in the manner of a UMTS stick 32, additionally having a SIM card 20.

Both mentioned functional modules 13 of the embodiment shown in FIG. 7 have a USB plug 21, which can be plugged into a socket-like USB connection 30 of the hand-held working apparatus 1. A cable connection can be attained through this.

The USB connection 30 can be part of the control device 10 and can be exposed to the outside.

Independently of the embodiment of the functional module 13, the latter can have a radio module 15 on Bluetooth basis. An Internet access can also be established via the radio module 15, in particular to establish a radio connection to an external data storage 14, possibly further by using a provided SIM card 20.

In particular in the case of the embodiment of the functional module 13 in the manner of a smartphone, the latter can be mounted in an adapter part 22. This can initially and essentially be a conventional smartphone mount, which captures the functional module 13.

According to the embodiment in FIG. 3, the adapter part 22 can be fastened directly to the hand-held working apparatus 1, here further for example in the area of the accumulator 7. The electrical supply of the functional module 13 across the apparatus-side accumulator 7 is present via a connection in terms of conduction, which is not illustrated in more detail in this exemplary embodiment. In the alternative, an inductive power supply can also be provided, however, in this regard.

Figure 2:
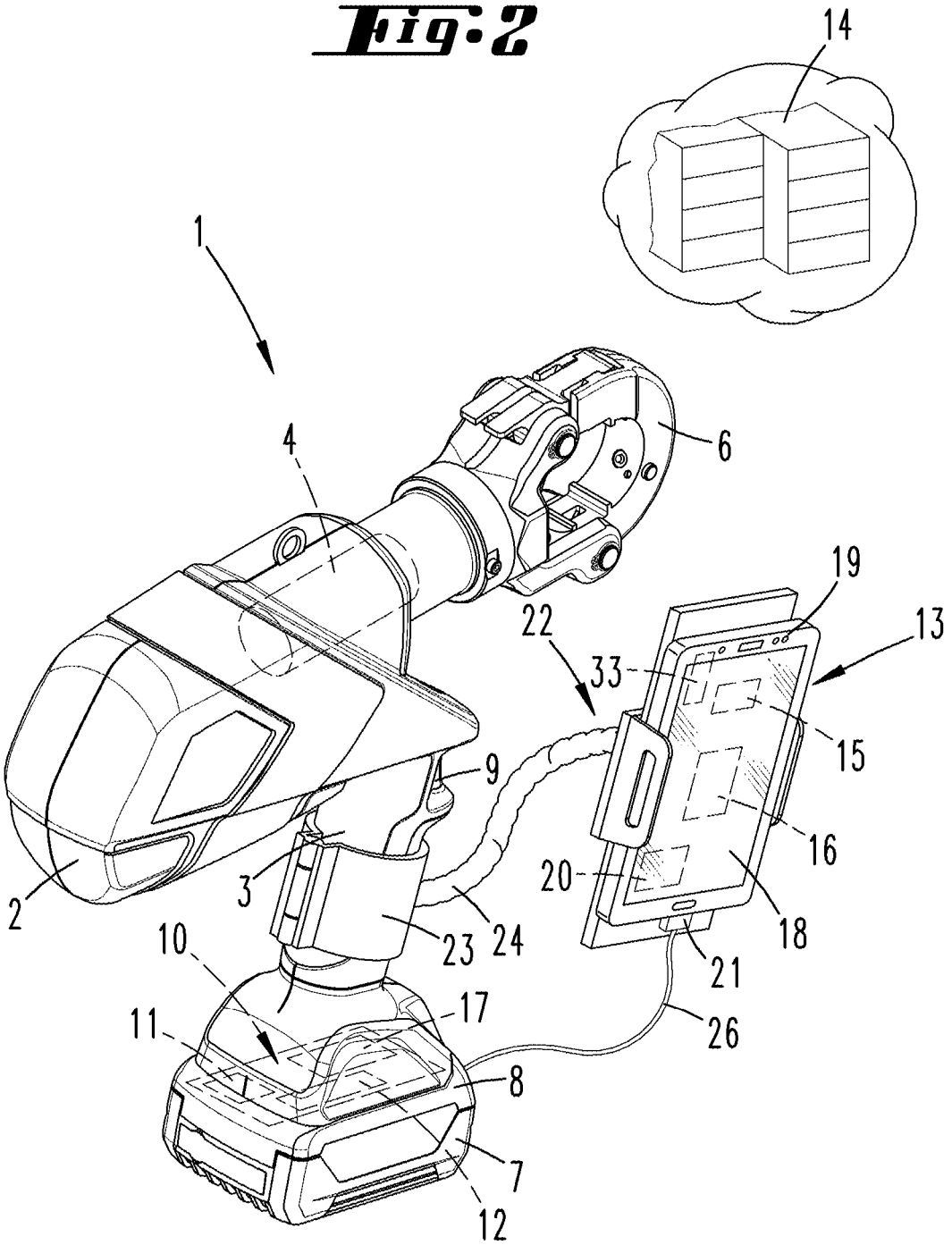
FIG. 2 shows the hand-held working apparatus according to the illustration in FIG. 1 comprising a functional module connected to the working apparatus via an adapter part, relating to an embodiment.

FIG. 2 shows an embodiment, in the case of which the adapter part 22 is fastened in the area of the body part 2 of the hand-held operating apparatus 1, here by using a fastening clip 23 attached in the handle area 3, from which a gooseneck-like adjustable mounting arm 24 originates. The adapter section supporting the functional module 13 is preferably connected in an articulated manner on the end side of this mounting arm 24.

Also as a result of such a gooseneck-like adapter part embodiment, the functional module 13, in particular in the case that the latter has a camera 19 and/or a display 18, can be moved into a convenient position, in which the possible camera 19 can document for example work process to be performed in the working area 25 of the hand-held working apparatus 1. Individual images can be generated thereby at regular or also irregular intervals or, possibly triggered by the user, but also automatically, but possibly also a video, which documents the work process, for example, in the alternative or in combination therewith.

Such images and/or videos can, as well as preferably, also be transmitted to the external data storage 14.

The electrical supply can thereby be attained via a connection 26 in terms of conduction in the form of a power cord, further in particular by using the functional module-side USB interface. The accumulator 7 of the working apparatus 1 or the accumulator receptacle 8, respectively, can also have a USB connection 30 in this case.

In the case of a compact functional module 13, which in particular has no display and no camera, for example according to the illustration in FIG. 5, such a functional module 13 can, in further exemplary embodiment, be received in the accumulator receptacle 8, which offers the adapter part 22 in this case. A pocket-like recess 27 can thus be provided in the accumulator receptacle 8 for the functional module 13. This recess can offer a connection 26 in terms for conduction for the power supply. In the alternative, an inductive power supply is also possible here.

The functional module 13 can thus be arranged in a hidden position (see also FIG. 6).

In this case, the adapter part 22 can further have cable connections 28 for guiding sensor signals of the accumulator 7 to the body part 2 of the hand-held working apparatus 1 or to the control device 10 thereof, respectively (see FIG. 5).

Figure 4:
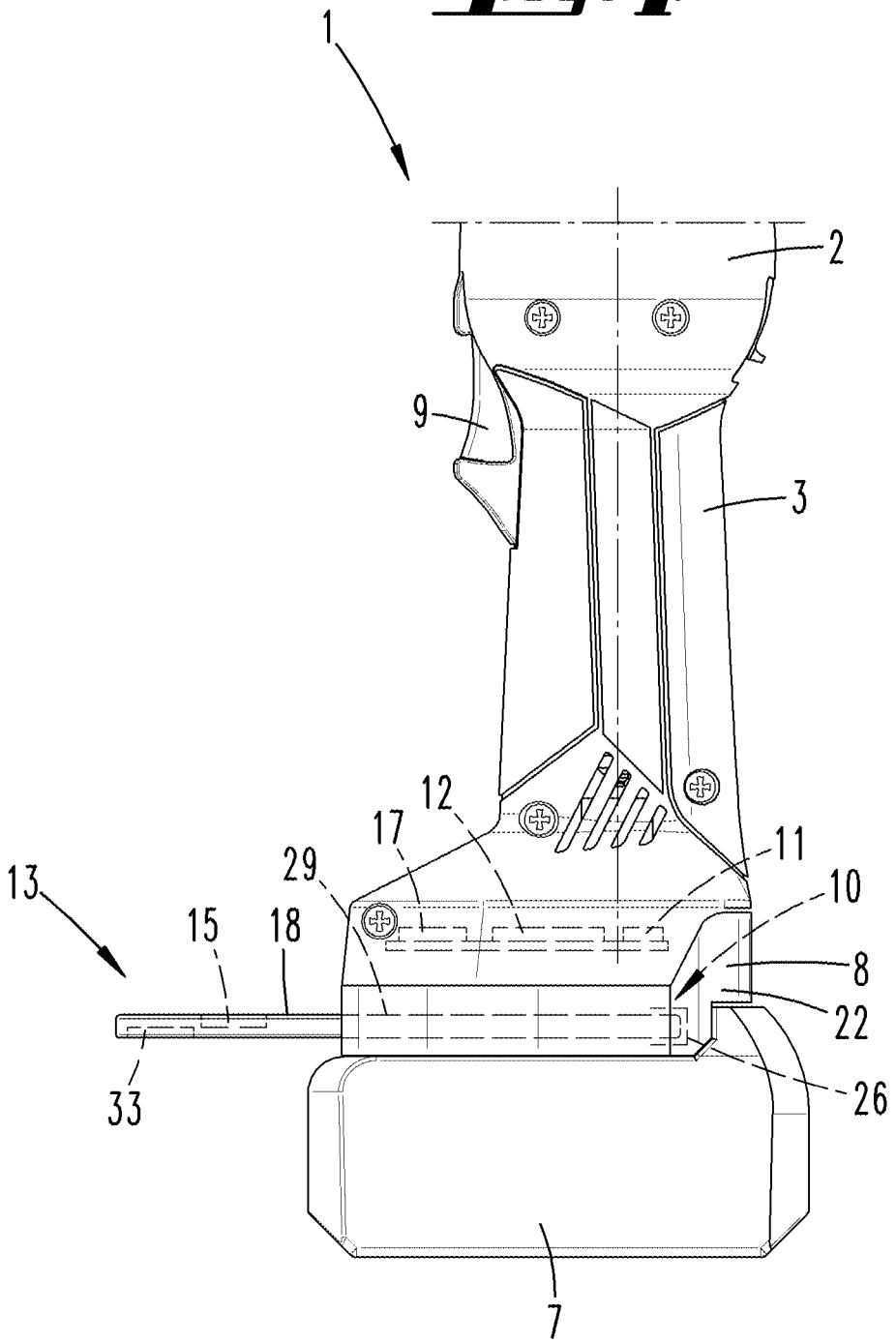
FIG. 4 shows a handle and accumulator area of a hand-held working apparatus in further embodiment comprising a plug-in mount of a functional module.

An adapter part 22 in the manner of a plug-in molding 29 can also be provided in the area of the accumulator receptacle 8 (see FIG. 4). Such a plug-in molding 29 can be open to the outside, for plugging the functional module 13, here for example in the form of a smartphone or the like, into the accumulator receptacle 8 from the outside. In this plugged-in position, a connection 26 in terms of conduction for the power supply can be present via the accumulator 7.

A clip arrangement of the functional module 13 to the hand-held working apparatus 1 is further also possible for example in this regard, possibly, as well as preferably, by interconnecting a correspondingly embodied adapter part 22.

In the state, in which the functional module 13 is connected to the hand-held working apparatus 1, a possibly provided camera 19 and/or a possibly provided display 18 of the functional module 13 is arranged so as to be exposed to the outside relative to the working apparatus 1 (see, for example, FIGS. 2 and 3).

In preferred embodiment, the functional module 13 is quasi part of the hand-held working apparatus 1. Preferably, no active action on the functional module 13 by the operator or user, respectively, of the working apparatus 1 is provided, in particular with regard to an activation of the module.

To protect the apparatus-side accumulator 7 in particular against a deep discharge, an electronic system is provided in the working apparatus 1, for example in the accumulator receptacle 8, which electronic system interrupts the supply below a certain voltage or after lapse of a specified time period. The turn-on of the power supply, in particular for the functional module 13, can thereby take place, for example, in response to every actuation of the hand-held working apparatus 1, in particular in response to an actuation of the trigger button 9. Such an activation or initiation, respectively, of a work process of the hand-held working apparatus 1 can be detected by the electronic system on the apparatus side in that a current flows from the accumulator 7 to the drive 4 or the corresponding voltage drops temporarily more strongly. A significant current and/or voltage change is thus captured, which leads to an activation of the functional module 13.

After such an activation, the functional module 13 initially and preferably connects to the control device 10 of the hand-held working apparatus 1 for the data exchange, whereupon a radio connection can further be established, possibly repeatedly and at regular intervals, to the remote data storage 14.

An application, which connects the functional module 13 to the hand-held working apparatus 1 via radio, for example via Bluetooth, can be started automatically in the functional module 13 with activation of the functional module 13. A remote control of the apparatus-side software can thus further also be initiated via the functional module 13.

The functional module 13 can also be capable of being turned off from afar in a remote-controlled manner via the radio connection. A signal, which is correspondingly transmitted via radio, is decrypted in the functional module 13, which, in preferred embodiment, leads to a deactivation of the functional module 13, which can also not be cancelled again by attempted actuation of the hand-held working apparatus 1 as a result of actuation of the trigger button 9. Accordingly, the hand-held working apparatus 1 can possibly also be shifted into an at least not completely usable state via such a remote-controlled deactivation of the functional module 13.

The above statements serve to describe the inventions, which are captured as a whole by the application, which further develop the prior art at least by means of the following feature combinations, in each case also independently, wherein two, a plurality, or all of these feature combinations can also be combined, namely:

A hand-held working apparatus, which is characterized in that a radio module 15 is further provided and that the radio module 15 is part of a functional module 13, which can optionally be connected to the hand-held working apparatus 1, wherein the functional module 13 can establish a connection 26 in terms of conduction only for the power supply upon a connection to the hand-held working apparatus 1, or can inductively be supplied with power.

A hand-held working apparatus, which is characterized in that the hand-held working apparatus 1 can also carry out a control of the work process without the functional module 13.

A hand-held working apparatus, which is characterized in that the hand-held working apparatus 1 and/or the functional module 13 has a display 18.

A hand-held working apparatus, which is characterized in that the hand-held working apparatus 1 and/or the functional module 13 has a camera 19.

A hand-held working apparatus, which is characterized in that the hand-held working apparatus 1 and/or the functional module 13 has a position sensor.

A hand-held working apparatus, which is characterized in that the hand-held working apparatus 1 and/or the functional module 13 has a GPS module.

A hand-held working apparatus, which is characterized in that the hand-held working apparatus 1 and/or the functional module 13 has a SIM card 20.

A hand-held working apparatus, which is characterized in that the functional module 13 has an antenna 33.

A hand-held working apparatus, which is characterized in that the functional module 13 has a USB plug 21.

A hand-held working apparatus, which is characterized in that the hand-held working apparatus 1 has a USB socket 30.

A hand-held working apparatus, which is characterized in that the functional module 13 has a data storage unit 16.

A hand-held working apparatus, which is characterized in that, upon connection to the hand-held working apparatus 1, the functional module 13 can be activated as a result of a significant current and/or voltage change captured at the accumulator 7 of the hand-held working apparatus 1.

A hand-held working apparatus, which is characterized in that the drive 4 of the hand-held working apparatus 1 can only be activated when the functional module 13 is activated.

A hand-held working apparatus, which is characterized in that the functional module 13 is arranged in an adapter part 22, which can be connected to a body part 2 of the hand-held working apparatus 1.

A hand-held working apparatus, which is characterized in that the adapter part 22 can be arranged between a body part 2 of the hand-held working apparatus 1 and the accumulator 7 of the hand-held working apparatus 1.

A hand-held working apparatus, which is characterized in that the adapter part 22 has cable connections 28, for guiding sensor signals of the accumulator 7 to the body part 2 of the hand-held working apparatus 1.

A hand-held working apparatus, which is characterized in that in the connected state to the hand-held working apparatus 1, a camera 19 and/or a display 18 of the functional module 13 is exposed to the outside.

A hand-held working apparatus, which is characterized in that a location notification can be transmitted via radio by means of the functional module 13 for each performed work process.

A method, which is characterized in that a radio module 15 is provided, which is part of a functional module 13, which can optionally be connected to the hand-held working apparatus 1, wherein the functional module 13 is brought into a functional connection with the hand-held working apparatus 1 only for the power supply.

A method, which is characterized in that the functional module 13 is set up in such a way that, in response to an activation for data exchange, it first connects to the control device 10 of the hand-held working apparatus 1.

A method, which is characterized in that the functional module 13 further also establishes a radio connection, possibly repeatedly and at regular intervals, to a remote data storage 14, which is provided independently of the hand-held working apparatus 1.

A method, which is characterized in that information, such as location information, performed work processes, terminated work processes, charge state of the accumulator 7, temperature of the hand-held working apparatus 1, ambient temperature, time, date, geographic height or optical and/or acoustic information, such as digital images, video or audio data, is transmitted to the remote data storage 14.

A method, which is characterized in that the hand-held working apparatus 1 can only be operated, when the radio connection between the functional module 13 and the hand-held working apparatus 1 is established.

A method, which is characterized in that the functional module 13 can be turned off in a remote-controlled manner.

A method, which is characterized in that the functional module 13 can be switched from a stand-by mode into an activated mode by deflection of the supply voltage.

All of the disclosed features (alone, but also in combination with one another) are essential for the invention. The disclosure content of the corresponding/enclosed priority documents (copy of the prior application) in its entirety is hereby also included into the disclosure of the application, also for the purpose of adding features of these documents into claims of the present application. With their features, also without the features of a referenced claim, the subclaims characterize independent inventive further developments of the prior art, in particular for filing divisional applications on the basis of these claims. The invention specified in each claim can, on principle, have one or a plurality of the features, which are specified in the above description, in particular provided with reference numerals and/or specified in the list of reference numerals. The invention also relates to designs, in the case of which individual features of those mentioned in the above description have not been realized, in particular insofar as they are discernably superfluous for the respective intended purpose or can be replaced by other technical means having the same effect.

LIST OF REFERENCE NUMERALS

| | |
|---|---|
| 1 | hand-held working apparatus |
| 2 | body part |
| 3 | handle area |
| 4 | drive |
| 5 | pressing tool |
| 6 | pressing jaw |
| 7 | accumulator |
| 8 | accumulator receptacle |
| 9 | trigger button |
| 10 | control device |
| 11 | microprocessor |

-continued

| | |
|---|---|
| 12 | data storage element |
| 13 | functional module |
| 14 | data storage |
| 15 | radio module |
| 16 | data storage unit |
| 17 | functional module |
| 18 | display |
| 19 | camera |
| 20 | SIM card |
| 21 | USB plug |
| 22 | adapter part |
| 23 | fastening clip |
| 24 | mounting arm |
| 25 | working area |
| 26 | connection in terms of conduction |
| 27 | recess |
| 28 | cable connection |
| 29 | plug-in molding |
| 30 | USB connection |
| 31 | Bluetooth dongle |
| 32 | UMTS stick |
| 33 | antenna |

The invention claimed is:

1. An assembly comprising:

an accumulator-operated hand-held working apparatus including a drive, an accumulator, and a control device including a data storage element and a microprocessor, wherein, in response to a trigger impulse, the control device is configured to automatically control a performance of a work process; and a functional module including a radio module, wherein the functional module is configured to be functionally connected to the hand-held working apparatus, configured to be switched from a stand-by mode into an activated mode as a result of at least one of a significant current and voltage change of the accumulator of the hand-held working apparatus detected by the control device, and further configured to be powered by the accumulator when in the activated mode.

2. The assembly according to claim 1, wherein the hand-held working apparatus is configured to carry out a control of the work process without the functional module.

3. The assembly according to claim 1, wherein at least one of the hand-held working apparatus and the functional module has at least one of a display, a camera, a position sensor, a GPS module, and a SIM card.

4. The assembly according to claim 1, wherein the hand-held working apparatus has a body part, and further comprising an adapter part connected to the body part, wherein the functional module is attached to the adapter part.

5. The hand-held working apparatus according to claim 4, wherein the adapter part is positioned between the body part and the accumulator.

6. The hand-held working apparatus according to claim 4, wherein the adapter part includes cable connections that transmit sensor signals of the accumulator to the body part.

7. The assembly according to claim 1, wherein when the functional module is connected to the hand-held working apparatus, at least one of a camera and a display of the functional module is exposed outside of the functional module.

8. The hand-held working apparatus according to claim 7, wherein a location notification is configured to be transmitted by the radio module of the functional module for each performed work process.

9. The assembly according to claim 1, wherein the functional module further comprises at least one of an antenna, a USB plug and a data storage unit.

10. The assembly according to claim 1, wherein the hand-held working apparatus further comprises a USB socket.

11. The hand-held working apparatus according to claim 1, wherein upon connection to the hand-held working apparatus, the drive of the hand-held working apparatus is configured to only be activated when the functional module is activated.

12. A method comprising:

providing a hand-held working apparatus including a drive, an accumulator, and a control device having a data storage element and a microprocessor;

providing a functional module including a radio module; and functionally connecting the functional module to the hand-held working apparatus;

detecting a change of at least one of a significant current change and a significant voltage change captured at the accumulator by the control device; and switching the functional module from a stand-by mode into an activated mode in response to the change, thereby powering the functional module by connection to the accumulator.

13. The method according to claim 12, further comprising providing a data storage which is remote to the hand-held working apparatus and to the functional module;

connecting the functional module to the control device of the hand-held working apparatus in response to an activation for data exchange between the hand-held working apparatus and the functional module; and thereafter establishing a radio connection between the functional module and the data storage.

14. The method according to claim 13, further comprising transmitting information including least one of location information, performed work processes, terminated work processes, charge state of the accumulator, temperature of the hand-held working apparatus, ambient temperature, time, date, geographic height information, optical information, acoustic information, digital images, video data and audio data, is transmitted to the data storage.

15. The method according claim 13, wherein the hand-held working apparatus is configured to only be operated when the radio connection is established.

16. The method according to one of claims 12 and 13, wherein the hand-held working apparatus is configured to only be operated when the functional module is turned off in a remote-controlled manner.

17. The method according to one of claims 12 and 13, wherein the hand-held working apparatus is configured to only be operated when the functional module is in the activated mode.

18. The method according to claim 12, further comprising providing a data storage which is remote to the hand-held working apparatus and to the functional module; and establishing a radio connection between the functional module and the data storage in response to an activation for data exchange between the hand-held working apparatus and the functional module.

19. The method according to claim 18, further comprising transmitting information including least one of location information, performed work processes, terminated work processes, charge state of the accumulator, temperature of the hand-held working apparatus, ambient temperature, time, date, geographic height information, optical information, acoustic information, digital images, video data and audio data, is transmitted to the data storage.

20. The method according to claim 12, further comprising establishing a radio connection between the functional module and the hand-held working apparatus, wherein the hand-held working apparatus is configured to only be operated when the radio connection is established.

* * * * *